United States Patent [19]

Long et al.

[11] Patent Number: 4,656,063

[45] Date of Patent: Apr. 7, 1987

[54] CURTAIN COATING METHOD

[76] Inventors: Harry F. Long, 2511 Chestnut View Dr., Lancaster, Pa. 17603; Donald J. Misselhorn, 1061 Sherry La.; Michael Tomchany, 2781 Old Orchard Rd., both of Lancaster, Pa. 17601

[21] Appl. No.: 874,449

[22] Filed: Jun. 9, 1986

Related U.S. Application Data

[62] Division of Ser. No. 769,695, Aug. 27, 1985.

[51] Int. Cl.[4] ..... B05D 1/30

[52] U.S. Cl. ..... 427/420; 118/DIG. 4

[58] Field of Search ..... 427/420; 118/DIG. 4, 118/300; 68/205 R; 366/289

[56] References Cited

U.S. PATENT DOCUMENTS 3,301,138 1/1967 Cox ..... 366/289 X

FOREIGN PATENT DOCUMENTS 891787 3/1962 United Kingdom ..... 118/DIG. 4

*Primary Examiner*—Shrive P. Beck

[57] ABSTRACT

The present invention relates to a curtain coating apparatus by which a foamable or foaming material is conveyed from a mixing apparatus through a distributor comprising a plurality of conveying tubes to a curtain coating slot. The apparatus comprises homogenization means for agitating the mixture such that the merging streams of foamable or foaming material are intermixed so as to provide a substantially uniform material which emerges from the curtain coating slot.

3 Claims, 3 Drawing Figures

Fig. 1
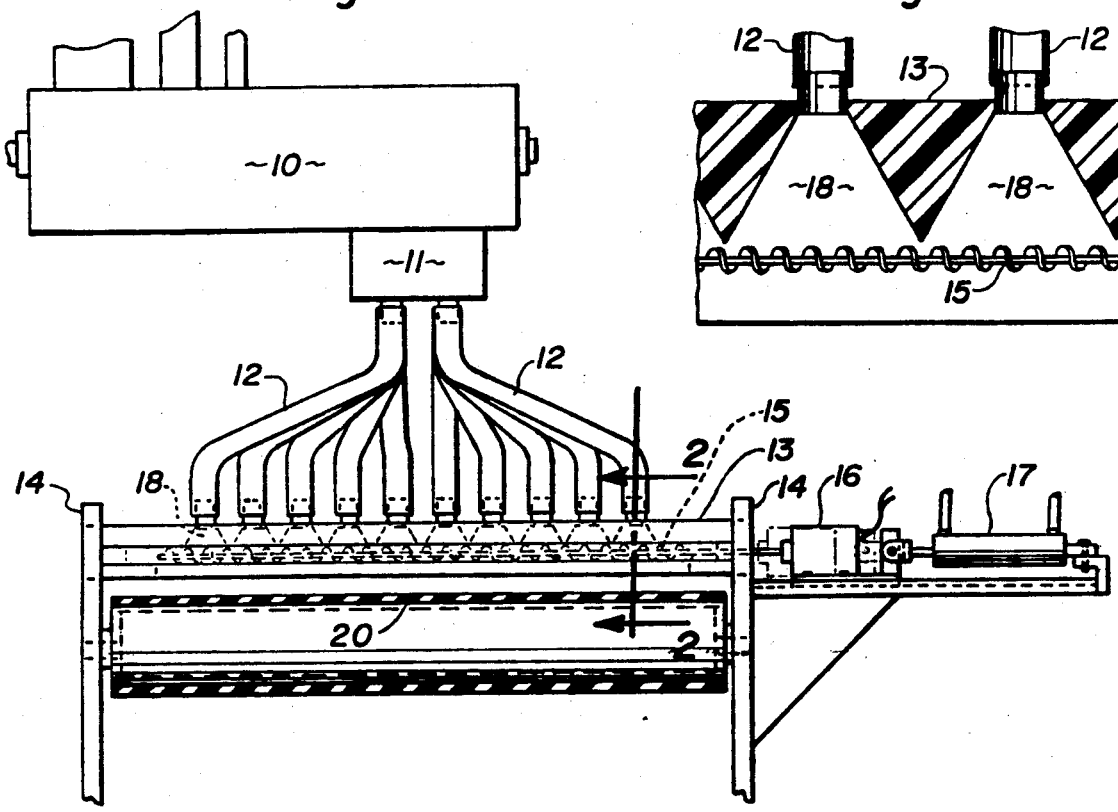
Fig. 3
Fig. 2
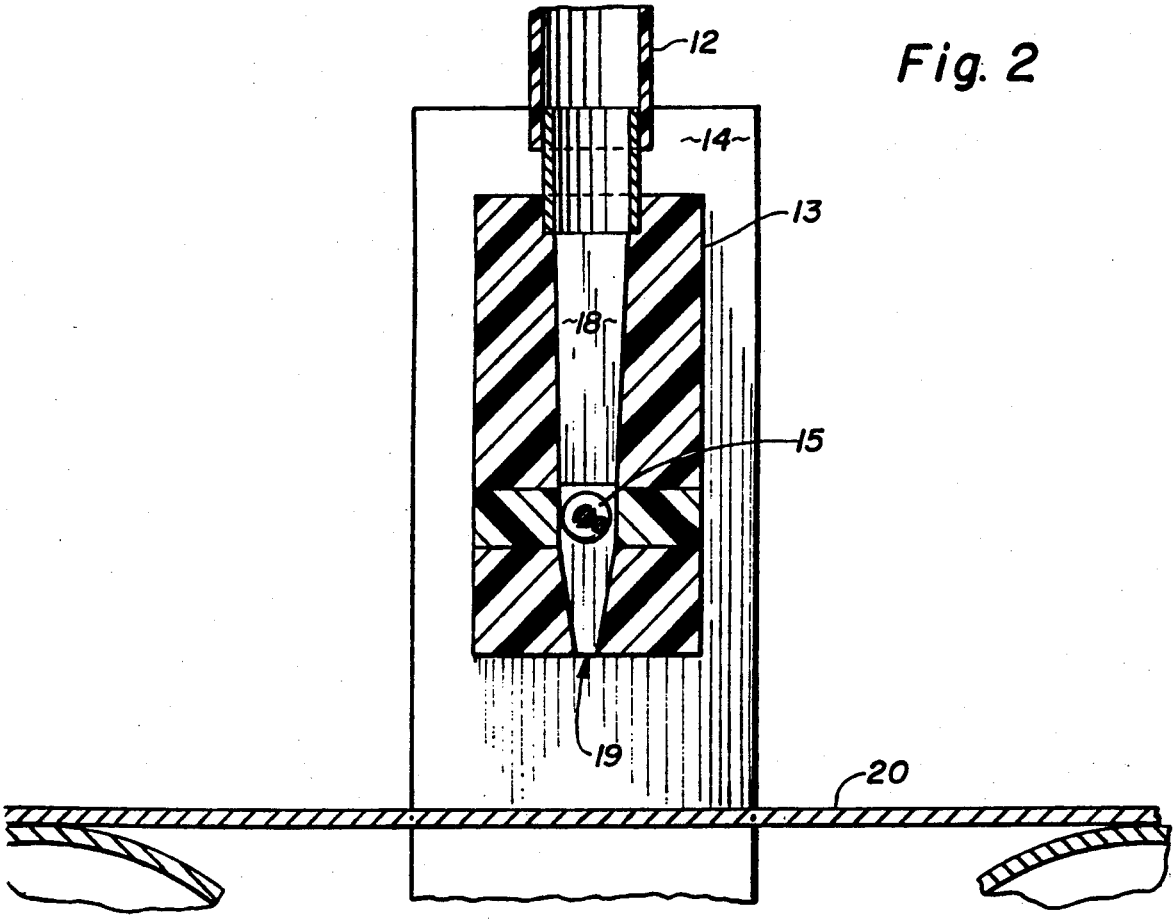

CURTAIN COATING METHOD

CROSS-REFERENCE TO RELATED APPLICATION

This is a division, of application Ser. No. 769,695, filed Aug. 27, 1985.

The present invention relates to a curtain coating apparatus, and more particularly to a curtain coating apparatus which may be utilized to coat a foaming mixture onto a substrate.

BACKGROUND OF THE INVENTION

U.S. Pat. No. 4,375,516, which issued to the assignee of the present invention, describes phosphate compositions derived from a metal oxide, wollastonite and phosphoric acid, the compositions being useful to provide foamed and unfoamed phosphate ceramic materials which are water resistant. The foam compositions are useful to prepare a variety of products; however in a commercial environment, such materials are often difficult to handle because it is desirable to continuously provide a uniform coating of foaming or foamable material to a substrate. The foaming compositions as described in U.S. Pat. No. 4,375,516 are difficult to apply in a uniform manner because they tend to foam vertically, and not laterally, when applied to a substrate. Attempts to deposit the material on a substrate and then to move it laterally by physical means provided generally unsatisfactory products. Similarly, depositing a series of streams of foaming material on a substrate also led to non-uniform products in that the streams of applied material tended to maintain their integrity, and did not readily mix with one another.

The Prior Art

Applicants are aware of only one reference which pertains to apparatus for applying a foam material to a substrate. U.S. Pat. No. 4,500,039 discloses apparatus for the distribution of a foam or a liquid material onto a moving web. A plurality of tubes feed the foam or liquid into a manifold having a plurality of output ports. The material flows through the ports into a reservoir and then is conveyed by gravity from the reservoir down a blade and onto the web surface. Such apparatus is not suitable to apply mixtures as disclosed in the present application, however, because the present mixtures are of relatively high viscosity and are undergoing a reaction which ultimately provides a hard-set material. The apparatus of the '039 patent would permit such materials to be held in the reservoir such that the setting reactions occurred before the material was deposited on the intended substrate.

Accordingly, one object of the present invention was to provide an apparatus and a process whereby a foaming composition could be applied to a moving substrate.

Another objective of the present invention was to provide an apparatus for homogenizing merging streams of viscous fluids.

Yet another objective of the present invention was to provide a process and apparatus whereby a uniform coating of foam could be applied across a relatively wide strip, yet the applied material would have a uniform appearance.

These and other advantages of the present invention will become apparent from the detailed description of preferred embodiments which follows.

BRIEF DESCRIPTION OF THE DRAWINGS

FIG. 1 represents a cross-sectional view of a curtain coating apparatus of the present invention.

FIG. 2 represents a sectional end view of said curtain coater taken along lines 2—2 of FIG. 1.

FIG. 3 represents a partial cross-sectional view of the manifold portion of FIG. 1.

SUMMARY OF THE INVENTION

The present invention relates to a curtain coating apparatus by which a foamable or foaming material is conveyed from a mixing apparatus through a distributor comprising a plurality of conveying tubes to a curtain coating slot. The apparatus comprises homogenization means for agitating the mixture such that the merging streams of foamable or foaming material are intermixed so as to provide a substantially uniform material which emerges from the curtain coating slot.

DETAILED DESCRIPTION OF PREFERRED EMBODIMENT

In one embodiment, the present invention relates to a homogenization apparatus, said apparatus comprising manifold means adapted to receive a plurality of viscous fluid streams; interfacing zones disposed within said manifold to bring contiguous streams into intimate contact; an exit slot in the bottom of said manifold, said slot running substantially the length of said manifold; and agitator means disposed longitudinally in said manifold means between said interfacing zones and said slot, said agitator means being capable of rotation and oscillation so as to induce homogenization of said streams.

In a second embodiment, the present invention relates to a curtain coating apparatus comprising mixing means suitable to provide a foamable composition, said mixing means comprising expulsion means to expel said composition from said mixing means; a distributor comprising a plurality of conveying tubes, said distributor being adapted to receive said foamable composition from said mixing means and to convey said composition to manifold means via said conveying tubes; and manifold means connected to said conveying tubes, said manifold means comprising (a) interfacing zones capable of bringing merging contiguous streams of said composition into intimate contact, (b) an exit slot in the bottom of said manifold means, said slot running substantially the length of said manifold, and (c) a rotatable and longitudinally oscillatable agitator means disposed longitudinally in said manifold between said interfacing zones and said slot, said expulsion means being capable of forcing said foamable composition through said apparatus and said agitator means being capable of inducing said contiguous streams of foamable composition to interface such that a substantially homogeneous curtain of foamable composition is emitted from said slot.

In a third embodiment, the present invention relates to a process for curtain coating a foamable composition, said process comprising the steps of selecting components suitable to provide a foamed phosphate ceramic material, said components comprising calcium silicate, a metal oxide, phosphoric acid and a foaming agent; passing said components through a curtain coater comprising (1) mixing means comprising expulsion means to expel a foamable composition from said mixing means, said components being mixed to provide said foamable composition, (2) a distributor comprising a plurality of conveying tubes, said distributor being adapted to receive said composition from said mixing means, and (3) homogenization means connected to said conveying tubes, said homogenization means comprising a manifold comprising interfacing zones, a longitudinal exit slot in the bottom of said manifold and a rotating and longitudinally oscillating agitator means disposed longitudinally in said manifold between said zones and said slot; and depositing said foamable composition on a selected substrate.

As previously noted, merging streams of viscous fluids do not readily intermix with one another. Instead they tend to remain as semi-merged streams which are readily discernable when the interfaced streams are deposited on a support surface. Accordingly, the present invention is directed to apparatus and a process for providing a homogeneous material, and in particular to a curtain coating apparatus which is capable of providing a uniformly deposited foaming or foamable composition.

A curtain coating apparatus as contemplated by the present invention is illustrated in cross-section in FIG. 1. The various components of the foaming mixture are fed proportionally into mixing apparatus 10 which provides a substantially uniform composition. It is now well known in the art that the rate of foaming of such compositions may be controlled by various means. In most circumstances, noticeable foaming will begin as soon as mixing occurs; however, in some circumstances it may be possible to delay foaming until after the mixture has exited from the apparatus. Accordingly, the term "foamable" as used herein is intended to include foaming or subsequently foamable compositions.

When mixed, the foamable composition exits from apparatus 10 into distributor 11 which distributes the mixture into distribution tubes 12. Tubes 12 convey the mixture to manifold 13 which comprises interfacing zones 18 (FIG. 3), each of which permits merging contiguous streams of incoming material to be interfaced with one another. In order to provide a uniform composition, however, it is also necessary to agitate the mixture so as to ensure full integration into a uniform curtain. This is achieved by causing agitator 15 to rotate by means of motor 16 while at the same time causing said agitator to oscillate longitudinally by means of hydraulic means 17. It is recognized, however, that means other than motor 16 and hydraulic means 17 may be utilized to induce rotation and oscillation of the agitator means. As indicated in FIG. 2, the diameter of agitator 15 preferably will be such that there is minimal clearance between agitator 15 and the walls of manifold 13.

Once the material is intermixed, it is compelled to exit through curtain coating slot 19 (FIG. 2) such that it is deposited onto a substrate residing beneath the slot. In a production environment, it is envisioned that a continuously moving web 20 will be provided beneath the slot, web 20 being itself suitable to receive the foamable mixture or, alternatively, being suitable to support a different substrate, such as a mold or plate, which will be suitable to receive the foamable material.

When practicing the present invention, a foamable mixture is prepared typically utilizing wollastonite, metal oxides such as aluminum oxide and magnesium oxide, a foaming agent such as magnesium carbonate, and phosphoric acid. The components are intermixed in apparatus 10 and, in the normal circumstance, the foaming reaction will begin almost immediately. Accordingly, it is important to convey the material in a reasonably rapid manner from the mixing apparatus into distributor 11 and through tubes 12 into the curtain coating manifold. To ensure that this conveying sequence is obtained, mixing apparatus 10 should be provided with means for expelling the mixture into the distributor. An insignificant amount of force is typically required and it is preferable to apply only sufficient force to ensure that the material moves continually through distributor 11 and tubes 12 into manifold 13. The expulsion may be obtained by the normal working of mixer 10, or an added means of expulsion, such as a screw extruder, may be provided between mixing apparatus 10 and distributor 11. All such modifications are within the scope of the present invention.

Materials having relatively high and relatively low viscosity can conveniently be applied to a substrate by using the present apparatus. Typically, viscosities of the foaming or foamable phosphate compositions may vary from about 300 to about 800 poise. Preferably, however, the viscosities will be adjusted such that they vary from about 400 to about 600 poise.

The present invention will be better understood by reference to the following examples which are provided by way of illustration, and not limitation.

EXAMPLES

Foamable compositions were prepared from the following dry blend and acid compositions.

| Dry Blend | |
|---|---|
| Component | Parts by Weight |
| Wollastonite | |
| Nyad 400 | 30.1 |
| Nyad 325 | 30.1 |
| Nyad G | 19.9 |
| Magnesium oxide | 9.3 |
| Magnesium carbonate | 4.0 |
| Talc (Nytal 200) | 6.6 |

Nyad and Nytal products are sold by Interpace Corporation.

| Acid Solution (5° C.) | |
|---|---|
| Component | Parts by Weight |
| Phosphoric acid (53% $P_2O_5$) | 75.9 |
| Aluminum oxide trihydrate | 10.1 |
| Boric acid | 2.0 |
| Water | 12.0 |

The dry blend acid solution and water were fed proportionally into a Readco continuous processor provided with extrusion screw segments which expelled the mixed composition into the distributor. Average viscosities were measured for these mixtures as indicated below, and it was noted that the viscosities tended to remain relatively constant as the mixture passed from the mixer through the distribution apparatus and out the curtain coating slot.

| Formulation | | | |
|---|---|---|---|
| Acid | Water | Dry Blend | Average Viscosity (poise) |
| 60.7 | 2.3 | 37.0 | 368 |
| 57.7 | 2.3 | 40.0 | 378 |
| 54.7 | 2.3 | 43.0 | 488 |
| .51.7 | 2.3 | 46.0 | 781 |
| 48.7 | 2.3 | 49.0 | 790 |

For viscosities which were above about 800 poise, relatively non-uniform flows were obtained through the apparatus and the mixtures tended to set too quickly, sometimes in the apparatus. Conversely, for materials which had viscosities below about 350 poise, products were obtained which had poor properties.

EXAMPLE 2

This example will illustrate the necessity for utilizing the rotating and longitudinally oscillating agitator. Agitator 15 was constructed of a 3/16-inch, acid-resistant rod wound with acid-resistant wire. Although this construction has been found to be quite satisfactory, other constructions (such as rods with blades and flanges) may also be utilized.

The composition of Example 1 having a viscosity of 488 poise was fed from the mixing apparatus through the curtain coating slot. Initially, agitator 15 was rotated at 1700 rpm and was also oscillated longitudinally twice per second. This produced a product with no lines of demarcation. During the remainder of the run, the following conditions were used. For one portion of the run, agitator 15 was completely deactivated; for another portion of the run agitator 15 rotated but did not oscillate; and for a third portion of the run agitator 15 oscillated, but did not rotate. In each circumstance, the curtain coated product exhibited lines of demarcation between the various streams of material, indicating that without rotational and longitudinal agitation, inadequate mixing of the contiguous streams was obtained.

The present invention is not restricted solely to the descriptions and illustrations provided above, but encompasses all modifications and envisaged by the following claims.

What is claimed is:

1. A process for curtain coating a foaming composition, said process comprising the steps of selecting components suitable to provide a foamed phosphate ceramic material, said components comprising calcium silicate, a metal oxide, phosphoric acid and a foaming agent;

passing said components through a curtain coater comprising (1) mixing means comprising expulsion means to expel a foamable composition from said mixing means, said components being mixed to provide said foamable composition, (2) a distributor comprising a plurality of conveying tubes, said distributor being adapted to receive said composition from said mixing means, and (3) homogenization means connected to said conveying tubes, said homogenization means comprising a manifold comprising interfacing zones, a longitudinal exit slot in the bottom of said manifold and a rotating and longitudinally oscillating agitator means disposed longitudinally in said manifold between said zones and said slot; and depositing said foamable composition on a selected substrate.

2. The process as set forth in claim 1 hereof wherein said foamable composition has a viscosity of from about 300 to about 800 poise.

3. The process as set forth in claim 1 hereof wherein said foamable composition has a viscosity of from about 400 to about 600 poise.

* * * * *